United States Patent [19]

Rahn

[11] Patent Number: 4,513,471

[45] Date of Patent: Apr. 30, 1985

[54] SWEEPER BLOWER DEVICE

[76] Inventor: Raymond A. Rahn, 22125 Albatross Cir., Farmington, Minn. 55024

[21] Appl. No.: 547,369

[22] Filed: Oct. 31, 1983

[51] Int. Cl.[3] ..... A47L 5/12

[52] U.S. Cl. ..... 15/340

[58] Field of Search ..... 15/339, 340, 345, 346; 406/148, 157, 159; 414/519, 520; 222/626, 627

[56] References Cited

U.S. PATENT DOCUMENTS

| | | | |
|---|---|---|---|
| 3,184,777 | 5/1965 | Norden | 15/340 |
| 3,249,264 | 5/1966 | Plesko et al. | 222/626 |
| 3,300,807 | 1/1967 | Berkowitz | 15/340 |
| 3,461,479 | 8/1969 | Tierney | 15/339 |
| 3,634,904 | 1/1972 | Larsen | 15/340 |
| 3,744,653 | 7/1973 | Jensen | 15/340 |
| 3,984,893 | 10/1976 | Ashley | 15/339 |
| 4,218,226 | 8/1980 | Boozer | 15/340 |
| 4,320,556 | 3/1982 | Kimzey et al. | 15/340 |

FOREIGN PATENT DOCUMENTS

| | | | |
|---|---|---|---|
| 1217672 | 12/1959 | France | 15/340 |
| 824160 | 11/1959 | United Kingdom | 15/340 |

*Primary Examiner*—Chris K. Moore

*Attorney, Agent, or Firm*—Donald A. Jacobson

[57] ABSTRACT

A combined sweeper blower for sweeping and collecting waste material for use with a utility vehicle powered by the mechanical power take-off of the vehicle. A hopper with a rear opening for collecting the swept waste material is mounted pivotably upon the vehicle and connected to a combined sweeper blower by a flexible duct. A rear cover closes the hopper rear opening excepting the duct opening. The sweeper blower mechanism is towed behind the vehicle by articulated links and mounted on height adjustable wheels. In use, the vehicle tows the sweeper blower over terrain to be swept while the sweeper blower sweeps and blows material from the ground through the flexible duct into the hopper. When the hopper is full the vehicle is stopped, the hopper tipped rearward, the cover removed from the rear opening of the hopper, and a gate positioned over the opening to the sweeper blower to block the duct to prevent the waste material from reentering the duct and to provide a path to the ground for the waste material over the top of the sweeper blower.

13 Claims, 6 Drawing Figures

SWEEPER BLOWER DEVICE

BACKGROUND OF THE INVENTION

I. Field of the Invention

This apparatus relates generally to apparatus for sweeping and collecting material, such as grass, gravel, leaves and other waste material from the ground, sidewalks, or large flat indoor areas and more specifically to a device which will sweep waste material from the ground, collect the material in a hopper, and dumping the hopper with an automatic dumping mechanism.

II. Description of the Prior Art

There is disclosed in the prior art a wide variety of devices for sweeping and collecting waste material from the ground. For example, reference is made to Boozer, U.S. Pat. No. 4,218,226, an apparatus for vacuuming particulate material has opposed inlet and exhaust openings and a fan connected to the exhaust opening to provide a partial vacuum in a chamber where the material is collected. A hydraulic piston lifts one end of the chamber to dump the material through a hinged door. In Norden, U.S. Pat. No. 3,184,777, a lawn sweeper supported by separate wheels with a rotatable brush adapted for power and propulsion by a garden tractor has a blower driven by the tractor which creates a partial vacuum in a duct immediately adjacent the sweeper for conveyance to and collection of the mowed grass in a wagon pulled by the tractor. In Ashley, U.S. Pat. No. 3,984,893 a vacuum sweeper device for use with a tractor-type rotary mower has a vacuum blower which is mounted on a frame and which is driven by a drive shaft connected to the power-take-off of the tractor. The frame is attached to the rear of the main frame of the tractor and includes provision for removably mounting a cylindrical container which collects material picked up by the vacuum blower. In Jensen, U.S. Pat. No. 3,744,653, a mobile lift dump vacuum apparatus which includes a vacuum system on a wheeled frame to pick up debris. A hopper on the frame is movable from a load position in which it receives debris from a discharge conduit of the vacuum system, to a dump position in which the debris is dumped. Articulated arms and linkages support the hopper for movement upwardly and rearwardly of the frame rear wheels for dumping the debris into elevated trash bins and the like. In Tierney, U.S. Pat. No. 3,461,479 a turf vacuuming apparatus including a frame supported by a set of wheels. An intake scoop and debris bag are supported on the frame and the scoop is connected with the debris bag by ducting. A blower assembly creates a partial vacuum in the ducting for pulling air in through the scoop and exhausting it into the debris bag. The blower assembly is driven by an engine which engine also drives a hydraulic pump. A hydraulic motor is drivingly coupled with a pair of the wheels and is connected with the pump by conduit means which includes a flow control valve.

In general, the devices described in the prior art have a blower to provide a vacuuming function which is separate from any sweeping action. In a number of these devices a separate power source is required. While Boozen and Jensen teach tilting the receptacle to provide a dumping action the mechanisms employed have a number of parts and provide no chute to conduct the waste material to ground.

The instant invention provides a combined sweeping blowing function using only one mechanism. A tilting container provides a dumping function for waste material while a mechanism operated by the tilting action opens the container and provides a path to ground for the waste material. The power for the unit is obtained from a utility vehicle.

SUMMARY OF THE INVENTION

This sweeper blower apparatus provides a sweeping and vacuuming capability to sweep, vacuum, and collect material from large horizontal surfaces and to automatically dump the collected material at any selected site. The apparatus is mounted upon a utility vehicle which provides the necessary power and mobility. A set of brushes radially affixed to a drive shaft and enclosed by a shroud, open at the bottom for intake and at the top for exhaust, provides the sweeping function as well as the blower function. This sweeper blower mechanism is mounted on castered wheels and pulled behind the vehicle by a pair of articulated links. Two wheels on each side of the sweeper blower have a height adjustment to change the vertical height of the sweeper blower mechanism for different types of terrain and material. The enclosure intake opening has rubber extensions at the front and sides to channel the air into the blower while providing flexibility for irregular surfaces. A hydraulically operated piston and cylinder attached between the vehicle and sweeper blower mechanism lifts the mechanism free from the ground for rapid transportation from one location to the other. A hopper pivotably attached upon a base is mounted on the vehicle bed with the pivot point at the rear of the vehicle. The hopper can be elevated about the pivot point by a hydraulic cylinder and piston mounted between the vehicle bed and the hopper. The hopper is enclosed excepting that the rear end is open and the front of the top has an adjustable screened opening provided for air exhaust. A separate rear cover for the hopper has an inclined clam shape such that when the cover is adjacent to the hopper rear opening a downward opening is defined by the cover sides. An extension from the floor of the hopper with a central opening extends slightly beyond the cover defined downward opening. A flexible duct connects this extension opening to the blower exhaust opening which is located below the extension opening. A gate pivotably mounted across the open rear end of the hopper can pivot from a position across the lower portion of the rear opening of the hopper to a position adjacent the hopper floor extension to cover the extension and the extension opening. These parts are interconnected by a mechanism arranged such that when the hopper floor is in a level attitude for filling the rear cover is adjacent the hopper to close off the rear end, excepting the downward opening through the extension, and the gate is pivoted to cover the lower end of the hopper. The rotating brushes will pick up material from the ground and the action of the brushes rotating within the housing will act as a blower to force the air and material upward into the duct against the inclined cover where it will be deflected above the gate into the hopper. The material will be retained in the hopper by gravity and by the exhaust screen while the air will exhaust through the front exhaust opening. To dump the material from the hopper the vehicle is stopped and the hopper elevated, which will incline the hopper floor to the rear, at the same time the rear cover is lifted and rotated away from the rear end of the hopper and the gate rotated away from the hopper to cover the opening to the duct in the floor extension. The floor extension is on the side opposite the pivot point from the hopper and it is lowered by the raising of the hopper which also lowers the duct out of the way. These changes provide a path to the ground for the material in the hopper and also close the duct opening to prevent clogging the sweeper blower when unloading the hopper.

DETAILED DESCRIPTION OF PREFERRED EMBODIMENTS

Figure 1:
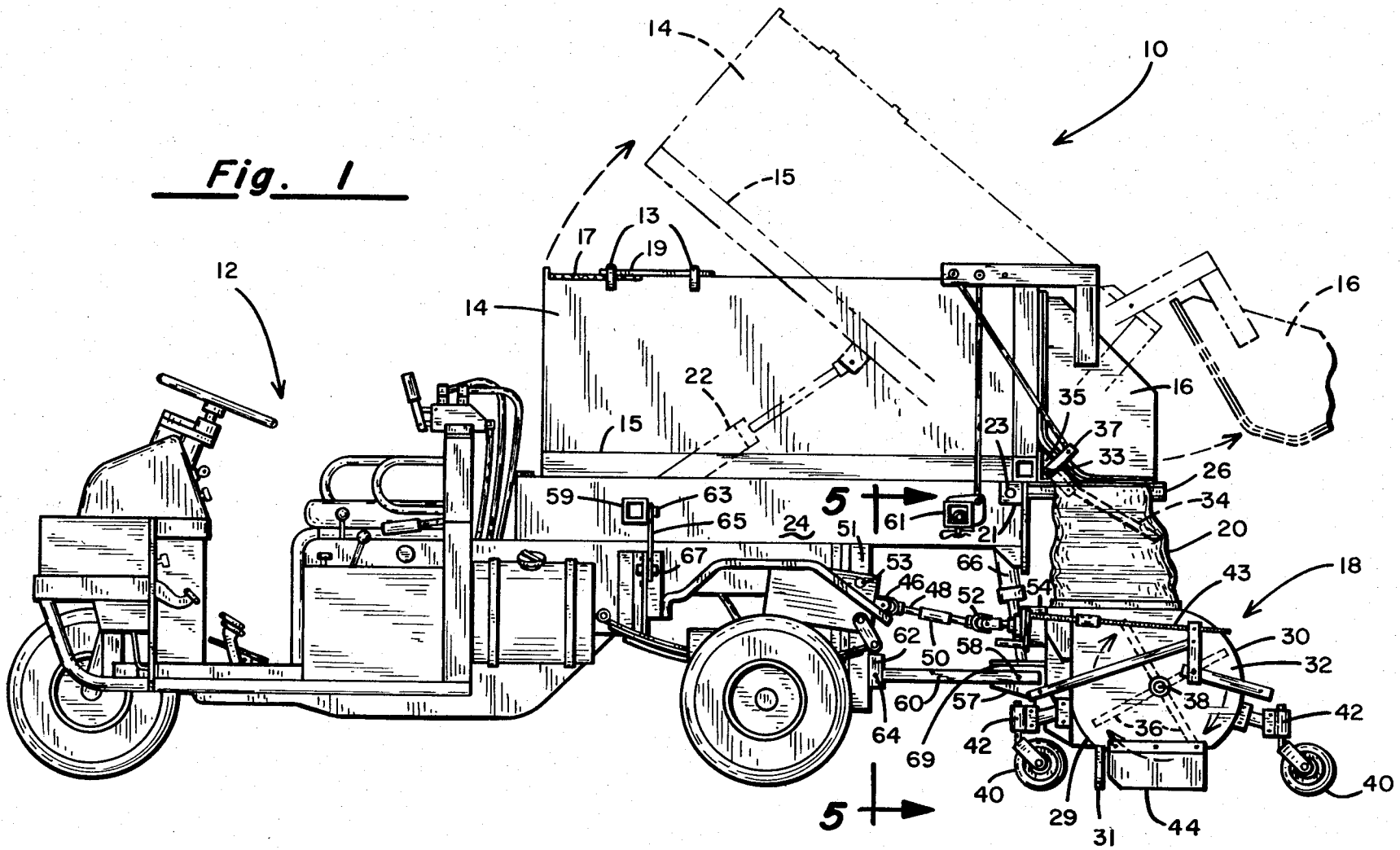
FIG. 1 is a left side view of the sweeper blower mounted upon the utility vehicle with an alternate position of the working parts shown in phantom outline.
Figure 2B:
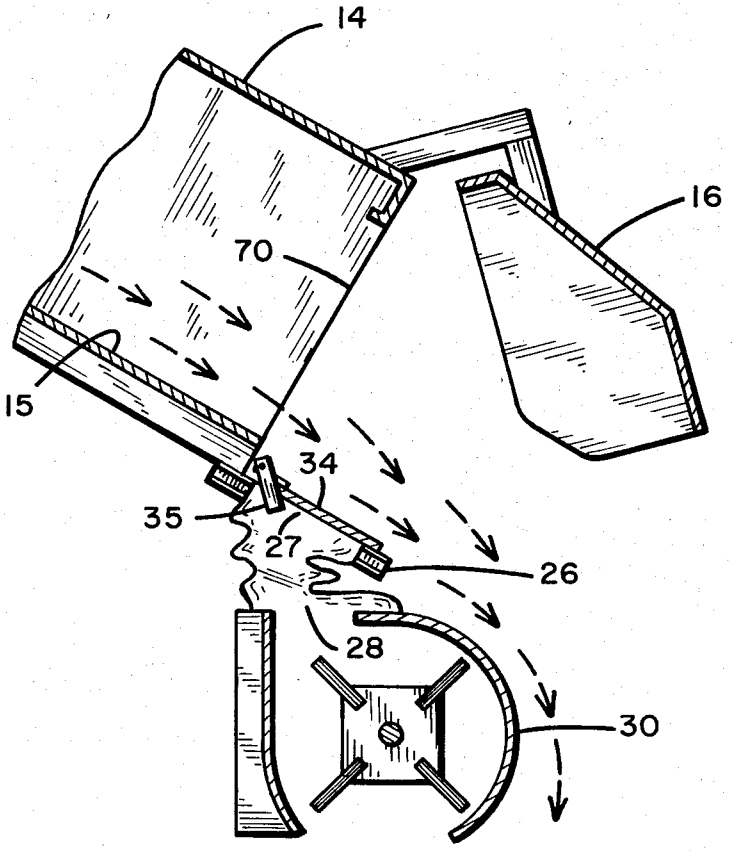
FIGS. 2*a* and 2*b* are functional left side views of the working parts shown when loading and unloading respectively.
Figure 2A:
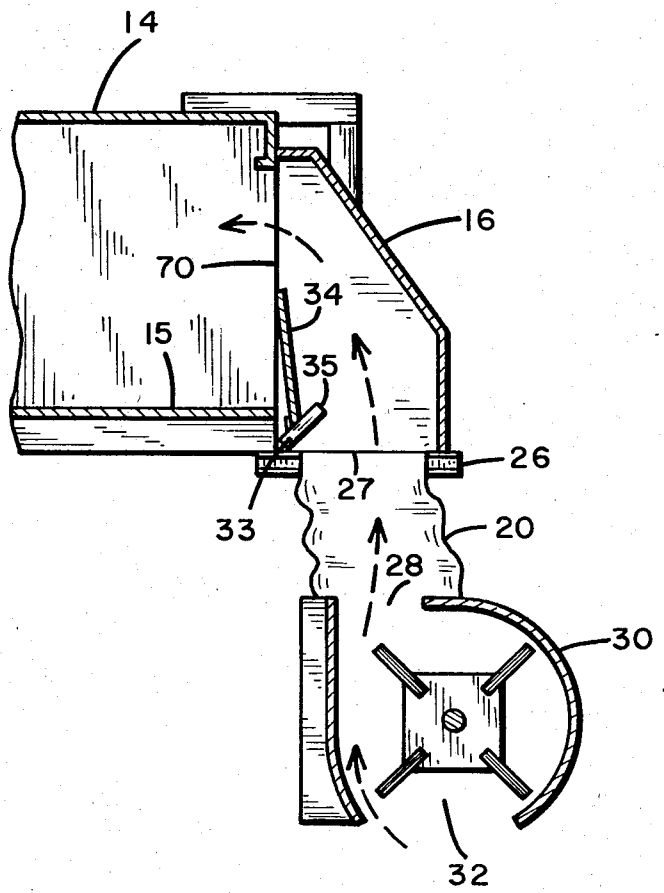

All descriptions as to location, orientation or rotation are given either in respect to the various drawings or in respect to the orientation of the vehicle. Referring to FIG. 1 the sweeper blower 10 is shown mounted upon a Cushman utility vehicle 12 or equivalent. The major working parts of sweeper blower 10 are a hopper 14 with a movable inclined clam shaped rear cover 16, the sweeper blower mechanism 18, and a flexible duct 20 connected between the hopper and the sweeper blower mechanism.

Hopper 14 pivots clockwise about its lower rear corner from a normal working position, shown in solid outline, to an elevated position, shown in phantom outline, with floor 15 elevated which is the position used to automatically dump the hopper. In all of the figures any parts shown in phantom outline are in the position occupied when hopper 14 is dumped. A hydraulic piston and cylinder 22, which will be described further later, is pivotably attached on each end between the bottom of hopper 14 and sweeper blower base 24 to provide the force necessary to raise and lower the hopper. Hopper 14 has two perpendicular extensions 21 extending downward from each of the lower rear corners of the hopper. Extensions 21 have bolts 23 mounted through a matching hole in their center which extend through a second matching hole in base 24 and are secured by nuts not shown. Bolts 23 and extensions 21 provide the pivoting connection of hopper 14 to base 24.

When hopper 14 is resting on base 24 inclined clam shaped rear cover 16 is held against the rightmost open end of the hopper, as shown in solid outline in the figure, to close the open end. When hopper 14 is rotated clockwise and elevated from base 24, rear cover 16 is rotated counter clockwise and lifted to the position shown in phantom outline. The force necessary to rotate and move clam shaped rear end 16 is derived from the rotation of hopper 14 using a mechanism which will be described later.

Flexible duct 20 is made up of canvas or similar strong flexible material and is attached at its upper end to a rectangular shaped opening 27, not shown in this figure, formed in a rectangular shaped rearward extension 26 to the floor of hopper 14. Flexible duct 20 is secured around rectangular opening 27 in extension 26 and connects this opening to and is secured around a second rectangular exhaust opening 28, not shown in this figure, which is in the top of housing 30 which encloses a combined sweeper 32. When hopper 14 is rotated clockwise extension 26 is lowered since it is on the opposite side of the pivot point. When extension 26 is lowered the attached upper end of flexible duct 20 is also lowered. Gate 34, shown in phantom in the hopper dump position in this figure has pins 33 which are rotatably inserted through proper sized holes in triangular extensions 35 from each side of hopper 14 and extensions 26 to provide a pivot point for the gate which is mounted across the rear opening of hopper 14. Pins 33 are secured on their outer end to arms 37 and on the inner end to gate 34 such that rotating the arms with respect to pins 33 will rotate the gate through the same angle. Arm 37 is rotated by a mechanism arranged such that when hopper 14 is in its lowered position for filling the lower portion of the rear opening of the hopper is sealed by gate 34, and when the hopper is raised the gate is rotated clockwise against extension 26 as shown in phantom outline in this figure. In this clockwise position gate 34 seals the upper opening to duct 20. The mechanism used to rotate gate 34 will be described later.

Housing 30 is generally curved to conform to the arc swept out by four perpendicularly mounted brushes 36 mounted upon a shaft 38 making up the sweeper 32. A metal deflection plate 29 attached across the inside front of housing 30 has a rubber deflector 31 attached to its lower end to direct any swept material upward toward duct 20 rather than forward and outward from vehicle 12. Housing 30 is supported by four wheels 40, two on each side, mounted in casters 42. A crank operated height adjusting mechanism 43 on each side permits raising and lowering the housing 30 with respect to the ground while at the same time keeping castors 42 perpendicular with the ground. This adjusting mechanism will be described later. A rubber skirt 44 on each side of housing 30 attached to the base, assists in directing the air flow through housing 30 while yielding to irregularities in the terrain.

The power for shaft 38 is obtained from a mechanical power take-off from vehicle 12. U-joint 46 and shaft 48 are driven from the power takeoff of the vehicle. Shaft 48 has a square cross-section and engages a matching enclosing square shaft 50 which can slip longitudinally over shaft 48 in order to provide a length adjustment. Shaft 50 drives a second U-joint 52 which in turn drives gear box 54. Gear box 54 changes the axis of the power train from a direction lengthwise of vehicle 12 to a direction perpendicular to the vehicle. A shaft from the gear box from this second perpendicular direction to a pulley 114 on the right side of the vehicle, not shown in this figure, is used to drive shaft 38. This mechanism will be described later.

Housing 30 has two projections 57 in the front on opposite sides which are each pivotably connected to arms 60 by bolts 58 through matching holes in each part and secured by nuts, not shown. Arms 60 are also pivotably connected to perpendicular rearward projections 62 on opposite sides of vehicle 12 by bolts 64 through matching holes in each part and secured by nuts, not shown. A hydraulic piston and cylinder 66 is pivotably attached to the rear center of bed 24 and to housing 30. Projections 57 each have a perpendicular horizontal projecting shelf 69 extending outward from the center of the housing 30. When piston and cylinder 66 are shortened then sweeper blower mechanism 18 is lifted from the ground while arms 60 holds mechanism 18 rearward which causes it to lift upward and pivot clockwise. The rotation of housing 30 is arrested by shelf 69 bearing against the rightmost end of arm 60 thus keeping sweeper blower mechanism 18 in essentially the same attitude as the mechanism is lifted as when resting on the ground. The lifting of sweeper blower mechanism 18 in this manner permits vehicle 12 to be driven with the mechanism free of the ground at high speed to a new working area. The detailed operation of hydraulic piston and cylinder 66 and attachment means will be described further later.

A front metal bar 59 and a rear metal bar 61 are mounted and secured to base 24 through holes in the side of the base and extend outward on each side from the base. A metal stud 63 on each side of base 24 has a hook 65 pivotably attached which engages a second metal stud 67 attached to vehicle 12 to secure the front end of sweeper blower 10. Extensions 51 project downward from base 24 on each side. Sweeper blower 10 is secured to vehicle 12 at the rear by pins 53 through aligned mating holes in both vehicle 12 and extensions 51 on both sides which are secured by cotter keys, not shown, mounted through mating holes through the pins.

In FIG. *2a* and *2b* the position of the major cooperating parts for loading and dumping hopper 14 are shown. In FIG. *2a*, the position of these parts with hopper 14 lowered with floor 15 horizontal can be seen. When hopper 14 is in this position inclined clam shaped rear cover 16 seals the rear opening 70 of the hopper 70 and extension 26 from floor 15 is also horizontal. Flexible duct 20 is extended between opening 27 in extension 26 and exhaust opening 28 in housing 30 to provide a conduit for material between these openings. Gate 34 is pivoted counterclockwise about pins 33 to a near vertical position with respect to the rear opening 70 in hopper 14 closing the lower end of the opening. In operation vehicle 12 is driven across the ground and sweeper 32 simultaneously rotated counterclockwise. This not only sweeps material up from the ground but also propels the material and surrounding air through housing 30 and upward through duct 20 against inclined clam shaped cover 16 where they are deflected leftward above gate 34 into hopper 14. This motion of sweeper 32 effectively performs the two required functions of sweeping and blowing in this one simple mechanism. The close fit of housing 30 with the sweeper 32 effectively forms a positive displacement pump for the air in the housing which combines the two functions. Gate 34 does not interfere with the loading process since material is thrown and carried by the moving air above the height of the gate before being deflected leftward by clam shaped rear end 16 but it does prevent any material being introduced into hopper 14 from moving rearward back into duct 20.

Referring to FIG. 1 the air entering hopper 14 is exhausted through a screen over exhaust opening 17 across the full width of the upper front portion of hopper 14. A sliding cover 19 which is free to slide under four L-shaped guides 13 mounted two in each side of hopper 14 permits changing the size of opening 17 as desired for different applications.

To dump hopper 14 the forward motion of vehicle 12 is stopped and the hopper is rotated clockwise to incline floor 15 in an attitude to be dumped, as shown in FIG. *2b*, and at the same time cover 16 is rotated counter clockwise and lifted away from rear opening 70 to clear the opening. Gate 34 is also rotated clockwise to seal rectangular opening 27 in extension 26. Flexible duct 20 is lowered automatically by the rotation of extension 26. This provides a clear path from hopper 14 to the ground for the material in the hopper. The material slides down floor 15 of hopper 14 across gate 34 and over the rear curved portion of housing 30 to the ground with no assistance required from the operator. As mentioned earlier, gate 34 not only provides a path for the material being dumped but also seals rectangular opening 27 at the upper end of duct 20 so that none of this material can reenter housing 30 to clog sweeper 32. These changes all occur together and are all caused by the clockwise rotation of hopper 14. Since hopper 14 is lifted by hydraulic piston and cylinder 22, the only effort required of the operator is the operation of a control valve.

Figure 3:
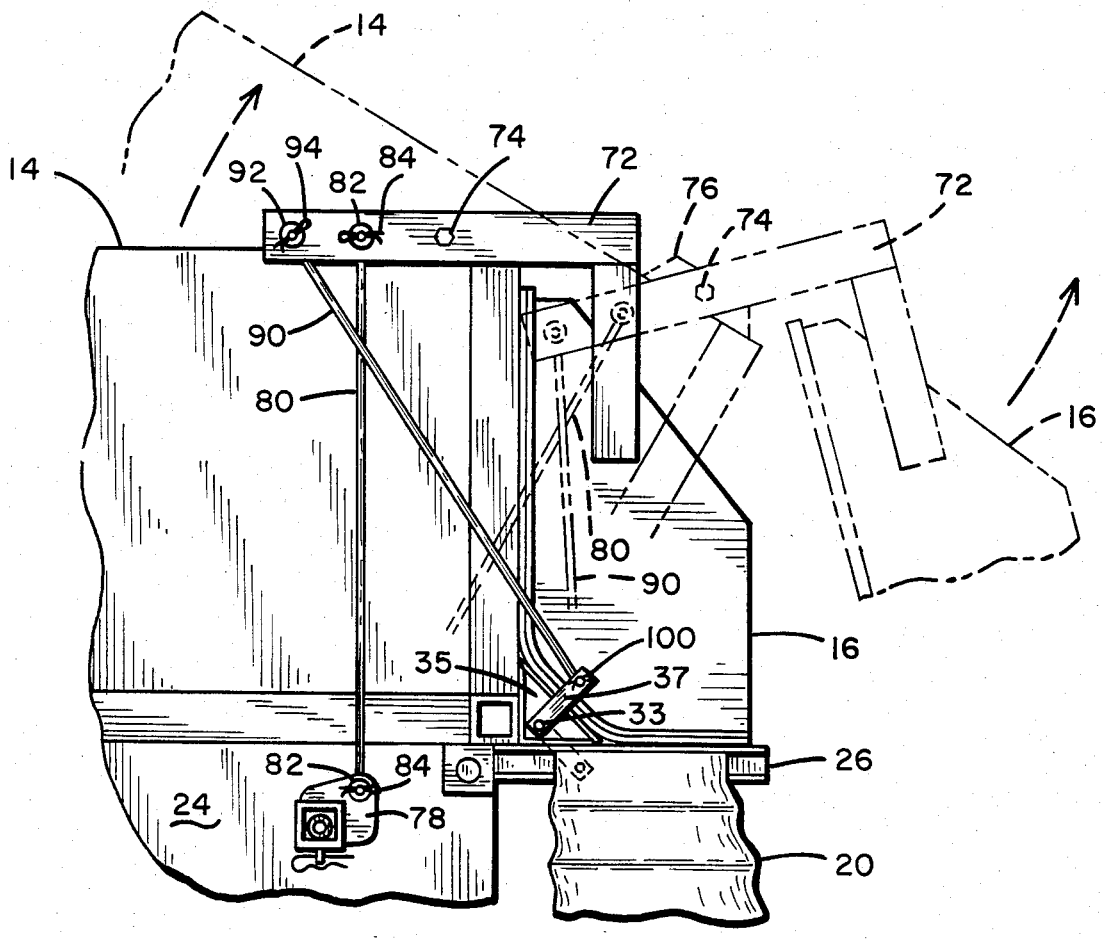
FIG. 3 is a left side view of the working parts excluding the sweeper blower with an alternate position of some of the working parts shown in phantom outline.

In FIG. 3 the mechanism required to convert the rotation of hopper 14 to the movement of these other parts is shown along with the rotatable attachment of the hopper. The mechanism is located on both sides of the sweeper blower 10 and functions of both sides are identical with the mechanism on the right side merely a mirror image of the mechanism on the left side. All parts are shown in solid outline in the position for loading hopper 14 and in phantom outline in the position for dumping the hopper. Two right angle brackets 72 are pivotably mounted on the rear upper end on opposite sides of hopper 14 by bolts 74 secured by nuts, not shown, through matching holes in upper extensions 76 attached to each upper rear side of hopper 14.

Mounting plates 78 are attached at right angles from each end of metal bar 61 at the rear of base 24. Rods 80 with a right angle bend in each end outward from hopper 14 are mounted through mating holes in brackets 72 and through plates 78 and are secured in place through washers 82 by cotter keys 84 through proper sized holes in each respective end of each rod. As described earlier arms 35 are attached to pins 33 which pivot within matching holes in triangular extensions 35 and cause gate 34, not shown on this figure, to rotate from a position across the rear of hopper 14 to a position adjacent to extension 26. This is accomplished by rods 90 each having an outward right angle bend in both ends mounted through matching holes in the left end of right angle brackets 74 and secured in position through a washer 92 by cotter keys 94 through matching holes in the upper end of the rods with the opposite ends of the rod connected through a matching hole in arm 35 and secured in position by cotter keys 100 through a matching hole in the bottom end of the rod. Cover 16 is attached between the right ends of the two right angle brackets 74.

All of the parts shown in FIG. 3 in full outline correspond to the location of these same parts in FIG. *2a* and in phantom outline to the parts in FIG. *2b*. As hopper 14 is raised and rotated clockwise by the extension of hydraulic piston and cylinder 22 rod 80 maintains the same distance between the mounting hole in bracket 72 and the mounting hole in plate 78 as the pivot point of the bracket of bolt 74 is carried upward and rightward by extension 76 which is mounted on hopper 14. This causes rod 80 to pull the left end of bracket 72 downward relative to hopper 14 which in turn causes the bracket to rotate in a counter-clockwise direction. This rotation of bracket 72 lifts and rotates rear cover 16 counterclockwise to the position shown in phantom outline clear of hopper 14 and at the same time the rotation of bracket 72 forces rod 90 downward. Rod 90 in turn rotates arm 37 clockwise which rotates gate 34, not shown in this figure, clockwise to overlay extension 26.

Because of the difficulty in clearly illustrating both positions of panel 26 and flexible duct 20, they are not shown, however they conform to the two positions shown in FIGS. *2a* and *2b*. Arm 35 rotates gate 34, not shown in this illustration, to the position shown in FIG. *2b* where the rectangular opening 27 in extension 26 is covered. The rotation of hopper 14 powers this mechanism which moves rear cover 16, lowers extension 26 with flexible duct 20, and moves gate 34 to extension 26.

Figure 5:
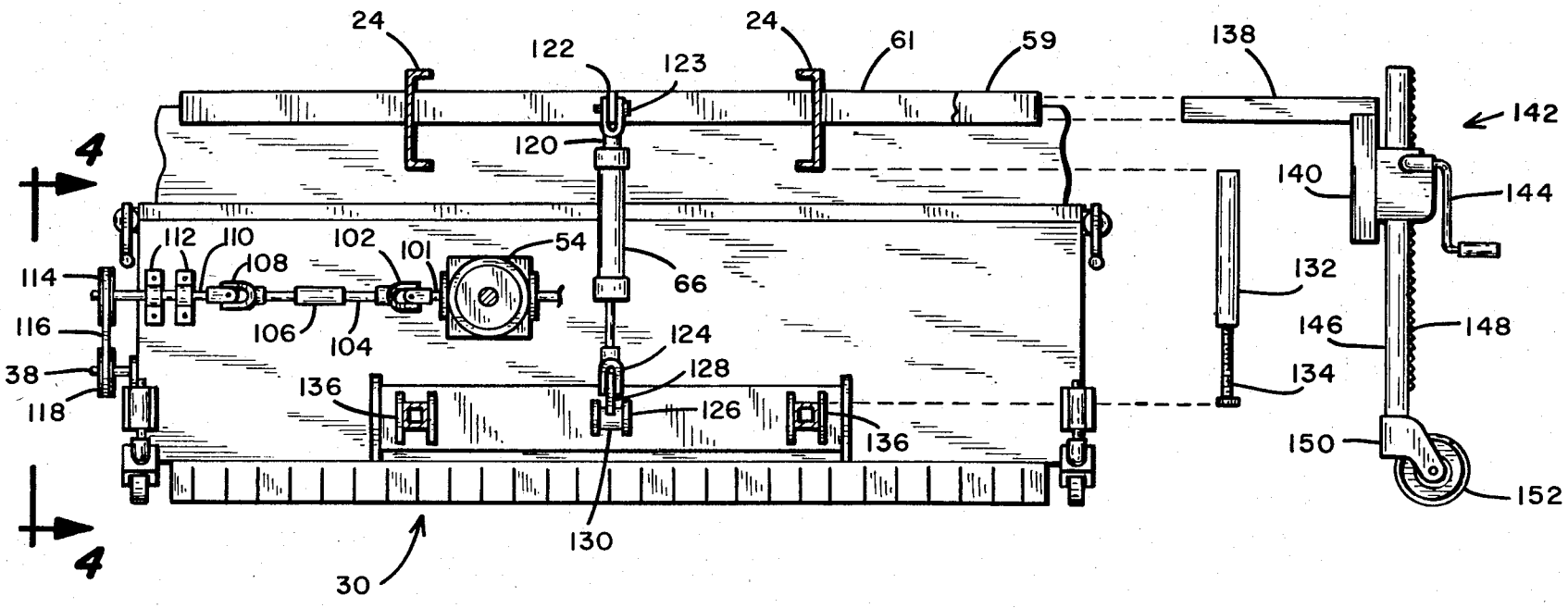
FIG. 5 is a cross-section of FIG. 1 taken along 5—5.

In FIG. 5 the portion of the power train not previously described, the use of piston and cylinder 66 in raising the sweeper blower mechanism 18 and the method of supporting sweeper blower 10 when free of vehicle 12 is illustrated. A shaft 101 from gear box 54 drives U-joint 102 which in turn drives square shaft 104 which has a square spline. Shaft 104 is enclosed by shaft 106 which has a longitudinal square opening slightly larger than shaft to provide a slipping length adjustment along the drive train. Shaft 106 drives U-joint 108 which in turn drives shaft 110 held by two sets of bearings 112.

A pulley 114 is secured to the opposite end of shaft 110. A belt 116 connects pulley 114 to a second pulley 118 which is secured to the end of shaft 38. Shaft 38 is mounted in bearings, not shown, in each end of housing 30.

Hydraulic piston and cylinder 66 has a bifurcated terminus 120 which is pivotably mounted through matching holes in the terminus and in bracket 122 which is secured to the back surface of bar 61. A bolt and nut 123 secure these parts pivotably together. A second bifurcated terminus 124 from piston and cylinder 66 is pivotably attached to a bracket 126 by means of a coupling 128 affixed to a pivoting pin 130 which is mounted and pivots within holes, not shown, which extend a portion of the distance from the interior of bracket 126 to the exterior surface.

A rod 132 having a bolt 134 mounted in a mating threaded hole in its lower end for length adjustment is one of two supports which are temporarily mounted above and against brackets 136 to support the rear of hopper 14 by bearing against the lower portion of base 24 when sweeper blower 10 is detached from vehicle 12.

Bar 138 is attached at right angles to a second bar 140 as part of a jack assembly 142 operated by a crank 144 which raises and lowers stand 146 by acting against notches 148 on the stand. A caster 150 holds a wheel 152 and is free to pivot about the end of stand 146. Bar 138 fits within the end of front bar 59 to support the right front of base 24 when free of vehicle 12. This jack assembly 142 is one of two such identical assemblies which mount in each end of bar 59 to support the front of base 24 when off of vehicle 12. When sweeper blower 10 is mounted on vehicle 12 then jack assemblies 142 are removed.

Figure 4:
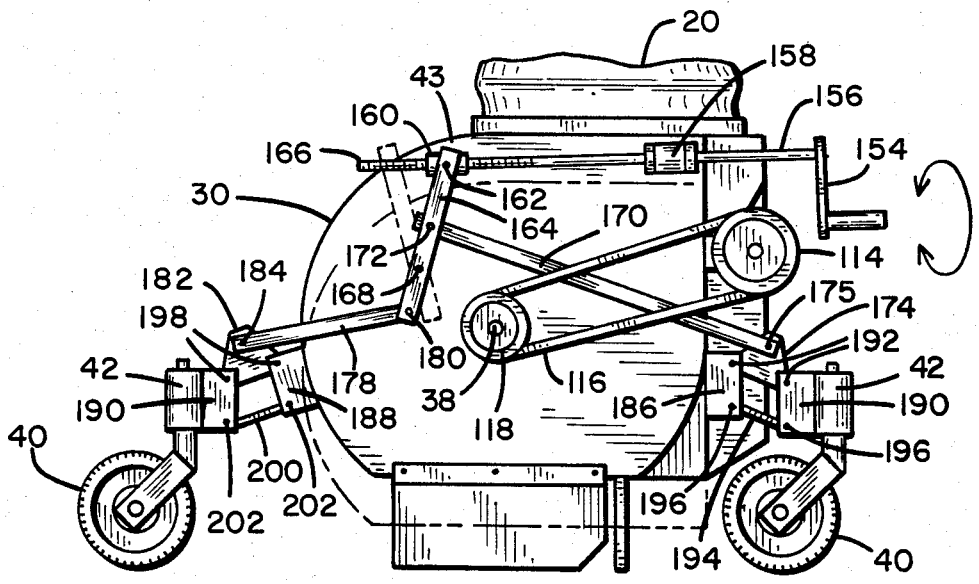
FIG. 4 is a right side view of the sweeper blower mechanism.

In FIG. 4 height adjusting mechanism 43 for raising and lowering housing 30 is shown in detail. A crank 154 is attached to a shaft 156 which is supported by a bearing 158 attached to the side of housing 30. A sleeve 160 is pivotably attached by a rivet 162 through proper size aligned holes in the parts to a link 164.

Shaft 156 has threads 166 and a threaded hole in sleeve 160 mates with the threads 166 to act in screw follower relation thereto. Link 164 is pivotably attached to enclosure 30 by a bolt 168 in proper sized holes through the center of the link and through the side of the enclosure which is held in place by a nut, not shown. A second link 170 is pivotably attached to link 164 by a rivet 172 through proper size aligned holes in the two parts and also to a first trapezoidal shaped part 174 by a rivet 175 through proper sized aligned holes in these two parts. A third link 178 is pivotably attached to link 164 by a rivet 180 through aligned proper sized holes in the two parts and to a second trapezoidal shaped part 182 by a rivet 184 through proper sized aligned holes in the two parts. The spacing between rivet 172 and bolt 168 and between rivet 180 and bolt 168 are the same. Enclosure 30 has a vertical front extension 186 and a vertical rear extension 188 which are also perpendicular to the respective front or rear surface of the enclosure. Casters 42 have a vertical extension 190 perpendicular to the caster. Trapezoidal shaped part 174 is pivotably attached to front caster extension 190 and housing front extension 186 by two rivets 192 through proper sized aligned holes in these parts. A link 194 is pivotably attached to front caster extension 190 and housing extension 186 by two rivets 196 through proper sized aligned holes. Trapezoidal shaped part 182 is likewise attached pivotably to housing rear extension 188 and rear caster extension 190 by two rivets 198. A link 200 is pivotably attached to extension 188 and rear caster extension 190 by two rivets 202 through proper sized aligned holes in the two parts.

Front caster extension 190, trapezoid shaped part 174, link 194 and housing extension 186 form a parallelogram whereby rotating trapezoid part 174 will cause link 194 to rotate by the same angle which will raise or lower front caster 42, while maintaining the caster in a perpendicular attitude with respect to the ground. Rear caster extension 190, trapezoidal shaped part 182, link 200 and housing extension 188 also form a parallelogram and will operate in the same manner whereby rotating part 182 will raise or lower rear caster 42 while keeping the caster axes perpendicular to the ground.

Using this mechanism by rotating crank 154 in a direction which will move sleeve 160 rightward will cause link 164 to rotate clockwise which in turn will move link 170 rightward and link 178 leftward by equal amounts because their attachment points to link 164 are equidistant from the axis of rotation of link 164 about bolt 168. This in turn will rotate part 174 clockwise and part 182 counter-clockwise by equal angles and lower both left caster 42 and right caster 42 by equal amounts while keeping the axis of both casters perpendicular to the ground as described earlier. The new adjustment will be retained without the necessity for any lock on shaft 156 because a force on sleeve 160 in either direction along shaft 156 will be perpendicular to threads 166 and thus cannot force the shaft to rotate and cause the wheel height to change which provides an automatic locking feature. There is a second adjusting mechanism on the opposite side of enclosure 30 for the two wheels 40 on that side having the same identical parts which function in the same manner with the only difference between the two sides being that the two mechanisms are mirror images of each other. The attachment of belt 116 to pulleys 114 and 118 can also be seen in this view.

These two adjusting mechanisms 43 provide a quick adjustment with automatic locking for the four wheels 40 of housing 30 permitting the housing with sweeper 32 to be set at any desired height above the ground.

The hydraulic cylinders provide great power and can be operated from any hydraulic system including a system provided with the utility vehicle and only require conventional hoses and valves to permit extending and retracting the piston and cylinders as desired to operate the hopper dumping system or the housing lifting system.

The combination of parts and mechanisms described provide a sweeper blower mechanism having a minimum of parts and complexity with all necessary operating features. The combination of the sweeping and blowing functions in one mechanism using only a simple rotating set of brushes reduces the machinery required for sweeping and blowing to an absolute minimum.

The apparatus is self supporting in storage making the connection and disconnection from a utility vehicle a simple matter. The automatic dumping feature is simple and effective and greatly facilitates the clean up of any given area. All mechanisms are simple and straightforward but perform the desired function and are readily available for replacement or repair. The hopper has a simple box shape and can be readily manufactured from sheet steel parts welded together or stamped from metal sheets if desired.

Although specific constructions of the hereindisclosed sweeper blower have been shown and described, it is obvious that those skilled in the art may make various modifications and changes to them without departing from the spirit and scope of the instant invention. It is to be expressly understood that the instant invention is limited only by the appended claims.

What is claimed is:

1. A refuse material collecting attachment for a motorized vehicle, said vehicle being of the type including a frame supported by a plurality of wheels, at least one of said wheels being driven by an engine, the engine having a power take-off member and said refuse material collecting attachment comprising:

(a) a box-like hopper having a floor, side, front and rear walls, the hopper being pivotably secured to said frame proximate the junction of said floor and said rear wall thereof, said hopper having an opening in said rear wall through which refuse material can pass;

(b) means for rotating said hopper about the pivot between a first disposition where the floor of said hopper is resting on said frame and a second disposition in which said floor is elevated relative to said frame;

(c) a wheel supported housing having a width dimension approximately the same as the width of said hopper and an elongated opening in the upper and lower surfaces of said housing;

(d) impeller means journaled for rotation within said housing about an axis which is aligned with the width dimension thereof, said impeller means having at least one flexible brush element;

(e) means coupling said impeller means to said power-takeoff member for rotating same whereby said brush element creates an upwardly directed suction force on articles of refuse material disposed below said opening in said lower surface of said housing;

(f) a flexible tubular conduit extending upwardly from said opening in said upper surface of said housing toward said opening in said rear wall of said hopper;

(g) a cover member pivotably secured to said hopper and extending between said opening in said rear wall and said tubular conduit when said hopper is in said first disposition for directing refuse material picked up by said impeller means through said opening in said rear wall of said hopper;

(h) means pivotably connected to said hopper proximate the intersection of said floor and said rear wall for gating the flow of refuse material; and (i) linkage means extending between said cover member and said gate means for positioning said gate means in blocking relationship with respect to said tubular conduit when said hopper is elevated to said second disposition.

2. The refuse material collecting attachment as in claim 1 and further including means for adjusting the distance between said lower surface of said housing and the ground.

3. A refuse material collecting attachment as in claim 2 wherein said height adjusting means comprises:

(a) screw follower means for controlling the disposition of a threaded sleeve; and (b) linkage means coupled to said sleeve and the front and rear of said housing for raising and lowering said housing with the movement of said sleeve.

4. The refuse material collecting attachment as in claim 1 and further including a flexible skirt member projecting downwardly from said housing and surrounding said opening in said lower surface of said housing.

5. The refuse material collecting attachment as in claim 1 wherein said linkage means includes means for pivoting said cover member from covering relationship with respect to said opening in said rear wall in said first disposition upon elevating said hopper to said second disposition.

6. The refuse material collecting attachment as in claim 1 wherein said cover member includes a deflector panel for steering refuse material passing upward through said flexible conduit through said opening in said rear wall.

7. The refuse material collecting attachment as in claim 1 and further including a cap enclosing the top of said hopper said cap having an opening.

8. The refuse material attachment as in claim 7 and further including a screen covering said cap opening and adjustment means to vary the size of said cap opening.

9. A refuse material collecting attachment for mounting in drawn relation to a motorized vehicle having a rearwardly dumping collection hopper, comprising in combination:

(a) a cover member mounting in pivoting relation to an opening in the rear end of said hopper;

(b) a housing mounting to said vehicle beneath said cover member and including sweeping means for upwardly directing refuse material;

(c) a flexible tubular conduit for directing the refuse material from said housing into said collection hopper;

(d) a gate member mounted in the flow path of the refuse material; and (e) linkage means mounted to said cover and to said gating means for holding said gate in non-blocking relation to the refuse flow during refuse collection and in blocking relation during the dumping so as to prevent the dumping of the collected refuse into said housing.

10. A refuse material collecting attachment as in claim 1 including means for adjusting the height of said housing relative to the ground, said height adjusting means comprising:

(a) screw follower means for controlling disposition of a threaded sleeve; and (b) linkage means coupled to said sleeve and the front and rear of said housing for raising and lowering said housing with the movement of said sleeve.

11. A refuse material collecting attachment as in claim 9 wherein said housing is pivotally mounted to said vehicle and said sweeping means is powered from said vehicle by a length adjustable drive shaft and including means for pivoting said housing upwardly and inwardly relative to said vehicle, thereby permitting a higher rate of vehicle speed.

12. A refuse material collecting attachment as in claim 9 wherein said cover member presents a concave interior surface relative to the rear end of said vehicle and to the flow of refuse material and whereby the refuse material is directed into the hopper.

13. A refuse material collecting attachment for mounting in drawn relation to a motorized vehicle having a rearwardly dumping collection hopper, comprising a combination:

(a) a cover member mounting in pivoting relation to an opening in the rear end of said hopper;

(b) a housing mounted to said vehicle beneath said cover member and including sweeping means for upwardly directing refuse material;

(c) a flexible tubular conduit for directing the refuse material from said housing into said collection hopper; and (d) means for preventing the dumping of refuse into said housing through said conduit during the dumping of collected refuse.

* * * * *